United States Patent [19]

Bumpus

[11] 4,181,352

[45] Jan. 1, 1980

[54] CHILDREN'S FURNITURE PIECE

[75] Inventor: Gary Bumpus, Columbus, Ohio

[73] Assignee: Michael D. Newland, Dayton, Ohio ; a part interest

[21] Appl. No.: 959,166

[22] Filed: Nov. 9, 1978

[51] Int. Cl.[2] ..... A47C 13/00

[52] U.S. Cl. ..... 297/3; 108/91

[58] Field of Search ..... 297/1, 3, 192, 193, 297/118; 108/50, 49, 91

[56] References Cited

U.S. PATENT DOCUMENTS

| | | | |
|---|---|---|---|
| 2,440,979 | 5/1948 | Schneider | 297/3 |
| 2,519,885 | 8/1950 | Carlson | 291/1 |
| 3,334,942 | 8/1967 | Breslow | 297/118 X |
| 3,556,586 | 1/1971 | Beardmore | 297/118 X |
| 3,592,506 | 7/1971 | Breslow | 297/1 |
| 3,879,083 | 4/1975 | Olsson | 297/1 |
| 3,950,796 | 4/1976 | Hollingsworth | 297/118 X |
| 3,982,784 | 9/1976 | Esser | 297/118 |

FOREIGN PATENT DOCUMENTS

| | | | |
|---|---|---|---|
| 2409127 | 9/1975 | Fed. Rep. of Germany | 297/3 |

*Primary Examiner*—Roy D. Frazier

*Assistant Examiner*—Peter A. Aschenbrenner

*Attorney, Agent, or Firm*—Becker & Becker, Inc.

[57] ABSTRACT

A children's furniture piece which can be used for different purposes by merely placing the furniture piece on different sides thereof so as to serve as desk, straight seat, inclined seat, and shelves. The furniture piece comprises side panels with straight and with inclined edges which latter have cutouts and protrusions that are so arranged that the cutout of one furniture piece receives the protrusions of the other furniture piece when stacking the furniture pieces one upon the other whereby automatically a slipping of the furniture piece in either one of two opposite directions will be prevented. The cutouts are correlated with the seat and desk position so that the elbow freedom of a child using the furniture piece as seat will be increased. The furniture piece is furthermore provided with lateral discs having the double purpose of increasing the stability of the furniture piece while also serving as armrest. The inclined edges of the furniture piece have the double purpose of serving as foot portions for the furniture piece when used as seat with a backwardly inclined backrest and as automatic locking device when stacking the furniture pieces to make up shelves.

5 Claims, 8 Drawing Figures

CHILDREN'S FURNITURE PIECE

The present invention relates to a piece of furniture for children, and more specifically to a piece of furniture which can serve different purposes by merely being turned from one position into another position. Furniture of this general type has become known. Thus, a child's furniture piece has been created which can be used as a chair, table, or a toy. This known furniture piece as described in U.S. Pat. No. 3,592,506, in addition to having fixed wall panels, also has a pivotally mounted panel which has to be pivoted into different positions in order to adapt the piece of furniture to its different intended uses. However, such a type of furniture is not practical since children are inevitably attracted by movable parts especially of furniture pieces, and tend to play with them in a fairly rough way, thereby loosening the pivot connection for the pivotable panel and even loosening the same to such an extent as to make the furniture no longer usable for the purpose it was intended. Moreover, additional means and steps are necessary to arrest the pivotal panel in the respective adjusted position.

Another drawback of this known type of furniture consists in that it is not stackable and, therefore, not practical for nurseries where the space is limited and the furniture pieces frequently have to be stacked to make the space available for dancing in a circle, such as ring-around-the-rosie, and other games played by the children, and also at the end of a day to store away toys and to permit an easier cleaning of the playroom.

Similar type pieces of furniture which are stackable have been described in U.S. Pat. No. 3,334,942. To this end, however, different units have to be employed, one being equipped with a tongue and the other one with a recess for receiving the tongue. Moreover, brackets have to be connected by screws to side panels to keep the stacked furniture pieces in place and prevent them from falling off each other. Thus, this type of children's furniture is rather expensive, aside from the fact that the brackets act as hooks by which the children can be hurt unless the brackets are removed when the furniture piece is not stacked which, of course, requires additional work and time.

Still another children's furniture piece has been described in U.S. Pat. No. 3,556,586, which can be used as an upright chair, a rocking chair and a desk. However, this type of furniture has the drawback that it cannot be stacked, and, when used as upright chair, cannot be used in connection with an identical furniture piece when employed as a desk, since the chair is too high.

U.S. Pat. No. 2,440,979 describes a four-way child's chair to be used as a rocking chair, vertical "high-boy", low stype chair, and lean-back chair. This type of chair, however, can likewise not be stacked to form shelves for books or toys, nor can it be used as desk together with the same type of chair, because the seat is far too high.

It is, therefore, an object of the present invention to provide a piece of children's furniture which can be used as a desk, as a chair, which in one position has a straight back and in another position has a slanted back, and can also be stacked to form shelves while only one model of furniture piece is necessary— in other words, while identical pieces of furniture can be used together, one as desk, and the other as chair, while, when stacked, the identical furniture pieces will be safely held in their position without requiring additional pieces or additional work.

These and other objects and advantages of the invention will appear more clearly from the following specification in connection with the accompanying drawings, in which.

Figure 1:
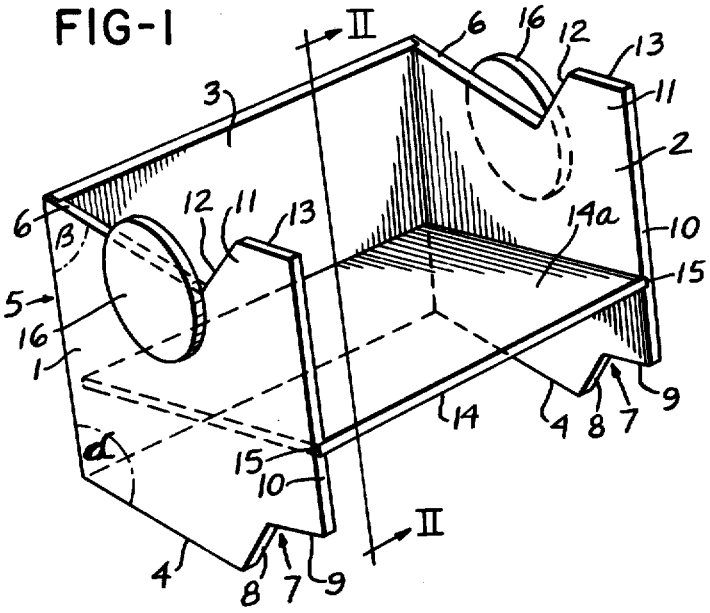
FIG. 1 is an isometric view of a furniture piece according to the invention when used as a backwardly inclined seat.

The children's furniture piece according to the present invention comprises two side panels arranged in spaced relationship to and facing each other. A third panel of substantially rectangular shape extends from and fixedly connects one end portion of one of said two side panels to the corresponding oppositely located end portion of the other one of said two side panels. A fourth panel is arranged between and is fixedly connected to said two side panels and has its plane extending at least nearly perpendicular to the plane of said third panel while intersecting said third panel closer to one of the longitudinal edges of said third panel than to the other one of the longitudinal edges of said third panel.

The furniture piece according to the present invention is characterized primarily in that each of said two side panels has a first edge and a second edge, both edges being arranged opposite to each other and leading away from said third panel while each first edge of each side panel forms an obtuse angle with a third edge pertaining to the respective panel and interconnects the respective first and second edges of the respective side panel. The second edge of each side panel forms an acute angle with the respective pertaining third edge, said acute angle being supplementary to said obtuse angle so that said first and second edges are on each side panel substantially parallel to each other. Each of said side panels also has a fourth edge spaced from and opposite said third edge, each of said first edges having those ends thereof which are remote from said third panel spaced from said fourth edge by a step defined by a first step section connected to the respective pertaining first edge and by a second step section interconnecting said first step section with said fourth edge. Each of said second edges has that end thereof which is remote from said third panel spaced from said fourth edge by a panel projection having a first projection section connected to the respective pertaining end of said second edge and being substantially parallel to said first step section. Each of said projections also has a second projection section interconnecting the pertaining first projection section with said fourth edge and being substantially parallel to said second step section of the same side panel. Furthermore, means are respectively connected to the outside of said side panels and project beyond the pertaining second edges as particularly clearly shown in FIGS. 1 and 3.

Referring now to the drawings in detail, the furniture piece illustrated in the drawings in different positions of use comprises two side panels 1 and 2 which are connected to each other by means of a substantially rectangular panel 3 to which said side panels are fastened in any convenient manner for instance by an adhesive, pegs or nails or the like. Each side panel 1 and 2 has a first edge 4 which with a second panel edge 5 defines an obtuse angle $\alpha$. Each side panel 1 and 2 also has a further edge 6 which with the edge 5 of the respective same panel defines an acute angle $\beta$. The angles $\alpha$ and $\beta$ are supplementary to each other so that the edges 4 and 6 are substantially parallel to each other.

Figure 2:
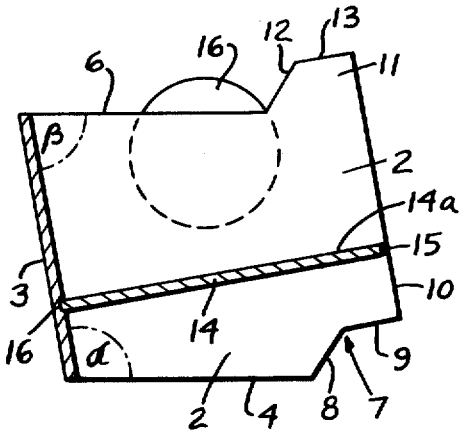
FIG. 2 represents a section taken along the line II—II of FIG. 1.

As will be seen especially from FIGS. 1 and 2, that end of said edges 4 which is remote from panel 3 is followed by a step 7 which is formed by a step section 8 connected to edge 4 and by a step section 9 leading to the panel edge 10. On the other hand, that end of edge 6 of each side panel 1, 2 which is remote from panel 3 is followed by a protrusion or projection 11 which is defined by a protrusion edge section 12 connected to edge 6 and by a protrusion edge section 13 connected to said edge section 12, as well as by that portion of panel edge 10 which is adjacent the protrusion edge section 13. It will furthermore be noted that protrusion edge section 12 has substantially the same length as and is substantially parallel to the step section 8, while the step section 9 is substantially parallel to protrusion section 13 and preferably has substantially the same length as protrusion section 13.

As will also be seen from the drawings, especially FIGS. 1-4, the children's furniture piece shown therein has an additional panel 14 the panel surface 14*a* of which is substantially perpendicular to panel 3. The panel 14 is shown inserted into a groove 15 in each of the side panels 1 and 2 but may instead thereof or in addition thereto be connected to the said side panels by an adhesive or in any other convenient manner. The panel 14 is additionally shown to engage a groove 16 (FIGS. 2 and 4) in the panel 13. The panel 14 which in the position shown in FIG. 1 is intended as seat, is closer to the step 7 than to the protrusion 11 to provide knee space for a child using the furniture piece as desk as can best be seen from FIG. 5. Panel 14 is so designed that with the furniture piece in FIG. 5 position, the lower edge of panel 14 is slightly set back with regard to edge 10.

Finally, connected to the outside of each side panel by any suitable means such as an adhesive, pegs or the like is a retainer member, for instance in the form of a disc 16 for a purpose which will be explained later. The discs 16 are so arranged on the outside of panels 1 and 2 that an imaginary straight line drawn from the outer end of the protrusion section 13 of each side panel to the oppositely located end of the respective same side panel forms a tangent to the respective disc 16.

From the above, it will be seen that when the furniture piece according to the invention occupies the position shown in FIGS. 1 and 2 with edges 4 engaging the floor, the surface 14*a* serving as seat is inclined to the floor and the panel 3 is inclined backwards. In the FIGS. 1 and 2 position, the discs 16 on the outside of the panels 1 and 2 may serve as an armrest. These discs, however, also have an important second purpose, as will be explained furtherbelow.

Figure 3:
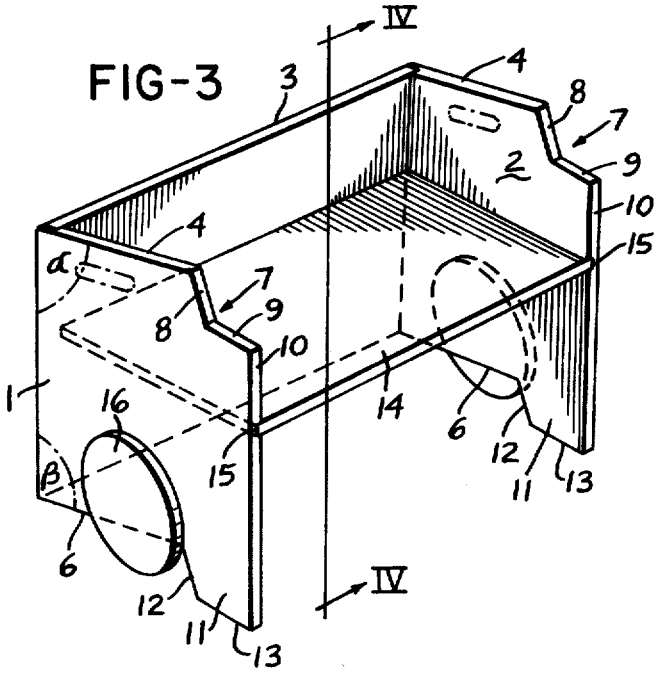
FIG. 3 illustrates an isometric view of the furniture piece of FIG. 1 but in a position to serve as a substantially horizontal seat.
Figure 4:
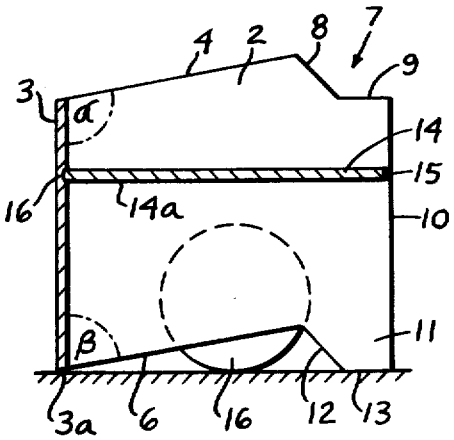
FIG. 4 is a section taken along the line IV—IV of FIG. 3.
Figure 5:
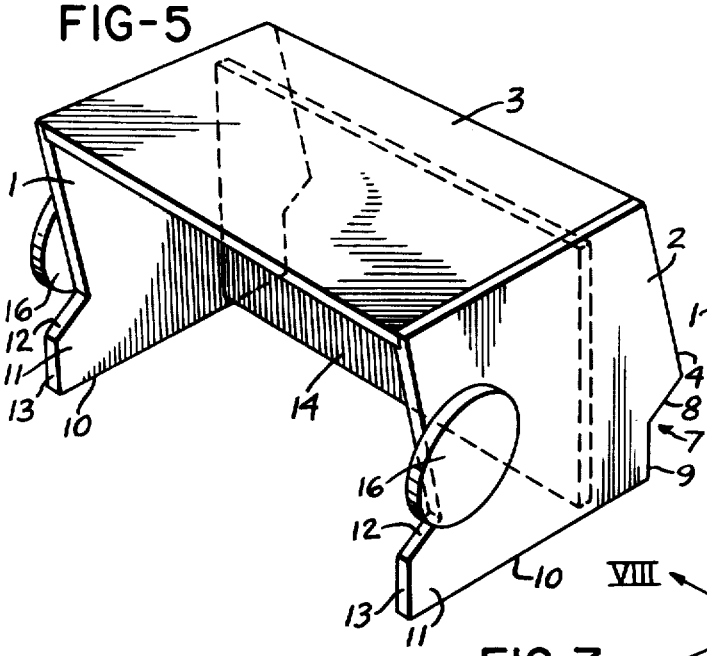
FIG. 5 is an isometric view of the furniture piece of FIG. 1 in a position to serve as a desk, as seen from the desk side which provides the knee and leg space.
Figure 6:
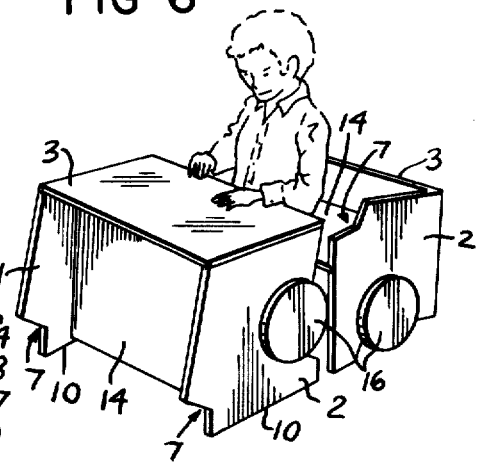
FIG. 6 illustrates in an isometric view the combination of two identical furniture pieces of the type shown in FIG. 1, but with one piece serving as desk while the other furniture piece serves as seat.

On the other hand, the furniture piece when occupying the position shown in FIGS. 3 and 4 serves as a seat with the seat formed by the panel 14 in a horizontal position and with the back formed by the panel 3 in a straight upward position. As will furthermore be seen from FIG. 5, the furniture piece, when resting on the panel edges 10, serves as desk with the panel 3 forming the desk surface proper and with the panel 14, due to its setback arrangement described in FIG. 1, providing for the necessary knee space of the child when sitting on another identical furniture piece but occupying the position of FIG. 3 in which the furniture piece forms a straight chair as shown in FIG. 6.

Figure 7:
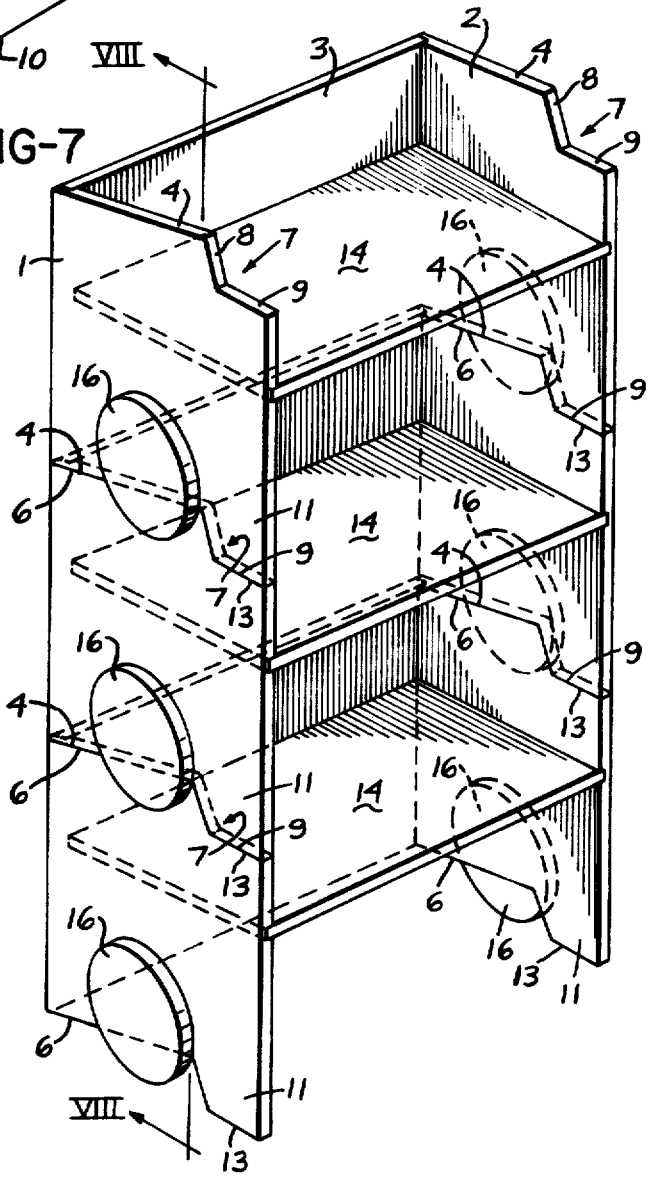
FIG. 7 shows three identical units of the furniture pieces of the type of FIG. 1 stacked to form a shelf which could be used for books as well as for toys.
Figure 8:
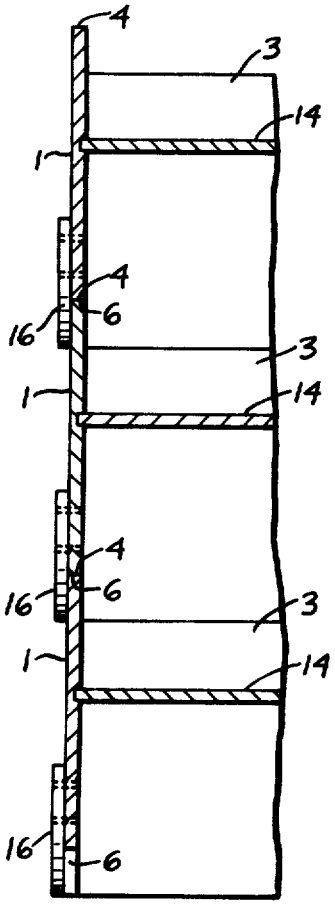
FIG. 8 is a section taken along the line VIII—VIII of FIG. 7.

Finally, when it is desired to stack the furniture pieces either for reasons to create space for instance in a nursery for games, or when it is desirable to stack the furniture pieces at the end of the period or the working day, to create shelves on which to store the toys or books while simultaneously facilitating the cleaning of the room, it is merely necessary to stack the furniture pieces one above the other in the manner shown in FIGS. 7 and 8 so that the edges 4 face upwardly. It will be seen that the protrusions 11 of the furniture pieces respectively stacked on a lower furniture piece fit into the cutout or step 7 of the latter. Inasmuch as the edge 4 is inclined downwardly and backwardly with regard to FIG. 7, and the edges 6 contact the edges 4, the furniture piece would if no other provision were made, slip backwards. This, however, is prevented by the protrusion section 12 engaging the cutout edge section 8 of the respective lower furniture piece which cutout section 8 is inclined downwardly and with regard to FIG. 7 forwardly. Thus, the stacked furniture pieces are positively prevented from sliding either backwardly or forwardly. At this opportunity, it may be mentioned that the cutout forming the step 7 also has another purpose, namely to increase the elbow-freedom of the child when sitting on the furniture piece as chair, and working at the desk.

The sideward sliding or slipping of the stacked furniture pieces is prevented by the discs 16 which hug the respective lower furniture pieces from the side as is clearly evident from FIGS. 7 and 8. Thus, the stacked furniture pieces are also positively prevented from slipping or sliding sidewardly so that actually the stacked furniture pieces form solid, secure shelves. It will thus be seen from the above, that the panel edges 4 have likewise a double purpose, namely in the shelf arrangement of FIGS. 7 and 8 that they serve in combination with the cutout edge sections 8 as positive means for preventing the stacked furniture pieces from sliding forwardly or backwardly, while the panel edges 4 in FIG. 1 position, that is when resting on the floor, place the seat in the inclined position with the panel 3 forming an inclined back rest.

The discs 16 as mentioned above serve the double purpose of armrest and means for preventing lateral sliding or slipping of the stacked furniture pieces. Due to the fact that the discs 16 are round, the child when resting its arms on the periphery of the desk does not run the risk of getting hurt. In addition thereto, the disc 16 has a third purpose as will best be seen from FIGS. 3 and 4, namely to serve as additional support of the furniture piece when the latter occupies its FIGS. 3 and 4 position, thereby contributing to the stability of the furniture piece which is particularly important in connection with children's furniture, inasmuch as children also have the tendency to climb on such furniture pieces.

As will be seen from the above, the children's furniture piece according to the present invention is extremely simple in construction, very rugged, and very versatile as to its manner of use, while it can be changed from one position of use to another position of use by merely turning the furniture piece about its longitudinal axis.

It is, of course, to be understood that the present invention is by no means limited to the specific structure shown, but also comprises any modifications within the scope of the appended claims. Thus, for instance, if desired, carrying slots could be provided in each of the side panels between the disc 16 and edge 4, as indicated by dot-dash lines in FIG. 3.

What I claim is:

1. A multi-purpose children's furniture piece which comprises: two side panels arranged in spaced relationship to and facing each other, a third panel of substantially rectangular shape extending from and fixedly connecting one end portion of one of said two side panels to the corresponding oppositely located end portion of the other one of said side panels, and a fourth panel arranged between and fixedly connected to said two side panels while forming a substantially right angle with said side panels and said third panel, said fourth panel being arranged closer to one of the longitudinal edges of said third panel than to the other one of the longitudinal edges of said third panel, each of said side panels having a first edge and an oppositely located second edge and also having a third edge located adjacent said third panel and interconnecting one end of said first and second edges on the respective side panel, each of said side panels also having a fourth edge spaced from the other end of said first and second edges and located opposite the pertaining third edge, said first and third edges of each of said side panels forming an obtuse angle with each other and said second and third edges of each side panels defining an acute angle with each other which latter is supplementary to the pertaining obtuse angle so that said first and second edges are on each side panel substantially parallel to each other, each of said other ends of said first edges being spaced from said fourth edge by a step in the respective side panel, said step being defined by a first step section connected to the respective pertaining first edge and by a second step section interconnecting said first step section with said fourth edge, each other end of said second edges being spaced from said fourth edge by a panel projection having a first projection section connected to the respective pertaining end of said second edge and being substantially parallel to said first step section, each of said projections also having a second projection section interconnecting the pertaining first projection section with said fourth edge and being substantially parallel to said second step section of the same side panel, and projecting means projecting from the outside of said panels beyond the pertaining second edges.

2. A furniture piece according to claim 1, in which said projecting means is a round disc so arranged that an imaginary plane visualized as extending from said second projection section to the remote end of said second edges forms a tangential plane to said disc.

3. A furniture piece according to claim 1, in which said fourth panel has that edge thereof which is remote from said third panel slightly set back with regard to said fourth edges.

4. A furniture piece according to claim 1, in which said side panels are provided with carrier cutouts arranged between said fourth panel and said first edges.

5. A furniture piece according to claim 1, in which said step sections define an obtuse angle with each other.

* * * * *